United States Patent [19]

VanBerkum

[11] Patent Number: 4,509,912

[45] **Date of Patent: * Apr. 9, 1985**

[54] COMBUSTION EFFICIENCY IMPROVING APPARATUS

[76] Inventor: Robert A. VanBerkum, 117 Fernwood Rd., Chagrin Falls, Ohio 44022

[ * ] Notice: The portion of the term of this patent subsequent to Apr. 28, 1998 has been disclaimed.

[21] Appl. No.: 338,080

[22] Filed: Jan. 8, 1982

Related U.S. Application Data

[60] Continuation-in-part of Ser. No. 162,628, Jun. 24, 1980, abandoned, which is a continuation-in-part of Ser. No. 949,899, Oct. 10, 1978, Pat. No. 4,264,297, which is a division of Ser. No. 750,647, Dec. 15, 1976, Pat. No. 4,157,238.

[51] Int. Cl.[3] ..... F23N 5/00

[52] U.S. Cl. ..... 431/76; 431/12; 236/15 E

[58] Field of Search ..... 431/12, 75, 76; 236/15 E

[56] References Cited

U.S. PATENT DOCUMENTS

| | | | |
|---|---|---|---|
| 3,096,020 | 7/1963 | Kraft | 236/14 |
| 3,549,089 | 12/1970 | Hamlett | 236/15 E |
| 3,814,570 | 6/1974 | Guigues et al. | 431/76 |
| 4,264,297 | 4/1981 | VanBerkum | 431/76 |

FOREIGN PATENT DOCUMENTS

| | | | |
|---|---|---|---|
| 259968 | 5/1913 | Fed. Rep. of Germany | 236/15 E |

*Primary Examiner*—Larry Jones
*Assistant Examiner*—Carl D. Price
*Attorney, Agent, or Firm*—Fay & Sharpe

[57] ABSTRACT

An efficiency improving apparatus (A) improves the combustion efficiency of a combustion apparatus (B) which includes a combustion chamber (10), a fuel supply rate regulator (32), an air supply rate regulator (42) and a combustion control (20) to control the fuel supply rate in response to firing rate demands and to control the air supply rate in relation to the fuel supply rate so that a preselected program of combustion conditions will be maintained during random variations in air and fuel quality, as well as during rapid changes in firing rate. The efficiency improving apparatus is connected between the combustion control and the air regulator to alter the air-fuel volume relationship by a percentage. The efficiency improving apparatus includes an exhaust gas analyzer (70), a comparator (72) for comparing the exhaust gas analysis with a preselected analysis, and an air-fuel ratio adjusting device for adjusting the set air-fuel volume relationship by the percentage in response to a difference between the exhaust gas and preselected analyses. The air-fuel ratio adjusting device includes a first shaft (80) which is rotated by the combustion control, a second shaft (84) which rotates to control one of the air and fuel supply regulators, preferably the air supply regulator, a continuously variable transmission (76) which interconnects the first and second shafts with an effective gear ratio such that angular displacement of the first shaft causes a corresponding angular displacement of the second shaft. The continuously variable transmission includes an angular displacement linkage (104) for causing a corresponding angular displacement of the first and second shafts with an effective gear ratio and a ratio adjusting device (106) which adjusts the effective gear ratio, hence the air-fuel volume relationship, by the percentage in response to the difference in the exhaust gas and preselected analyses.

20 Claims, 13 Drawing Figures

94
120
122
114
112
98
132
134
136
116
138
152
164
80
92

COMBUSTION EFFICIENCY IMPROVING APPARATUS

BACKGROUND OF THE INVENTION

This application is a continuation-in-part of application Ser. No. 162,628, filed June 24, 1980, now abandoned, which in turn is a continuation-in-part of application Ser. No. 949,899, filed Oct. 10, 1978, now U.S. Pat. No. 4,264,297, which in turn is a divisional of application Ser. No. 750,647, filed Dec. 15, 1976, now U.S. Pat. No. 4,157,238.

This application relates to the art of combustion control and fuel conversation. More particularly the invention relates to an apparatus for automatically controlling the air-fuel mixture for combustion devices. The invention finds particular application as an addition to existing boilers, furnaces, and other combustion devices to improve their fuel efficiency. The invention will be described with reference to a boiler, but it will be understood that the invention is also applicable to other combustion devices including furnaces, ovens, some internal combustion engines, and the like.

In the past, it has been a common practice to control the air and fuel supply or flow rates with a jackshaft system. A jackshaft system comprises a jackshaft to which is attached a first lever or cam for controlling the amount of fuel and a second lever or cam for controlling the amount of air which is fed to the combustion chamber. A mechanical linkage generally connects the levers or cams of the jackshaft with a fuel valve and an air flow control. When it is desired to increase or decrease the rate of heat release in the combustion chamber, i.e., increase or decrease the firing rate, the jackshaft is rotated by a combustion control causing more or less fuel and air to be fed to the combustion chamber. The dimensions and sizes of the jackshaft, levers or cams, and the mechanical linkages constrain the air and fuel supply rates on a volume basis to a predetermined fixed relationship one to the other. Because this fixed relationship is on a volume basis, the desired combustion conditions will only be maintained if the absolute quantity of oxygen in molecular terms per unit volume of air delivered remains constant, and the combustibles content of the fuel delivered also remains constant in molecular terms relative to their oxygen requirement for complete oxidation.

Analysis indicates that the amount of oxygen delivered per unit volume of apparent air flow can vary as much as ±9% as air temperature and/or humidity vary. To maintain constant combustion conditions from a chemical reaction standpoint it would be necessary to compensate the calibration of the fixed air flow control linkage by a corresponding factor of ±9%. In other words, assuming for example that a compensation to air flow of +9% is required, in a jackshaft type of system, a correction factor of +9% would have to be applied to the calibration of the air control device.

Similarly, the quality of fuels in the same class or designation also varies. For example, the heating valve of fuel oil varies by some 9%, and its specific gravity and viscosity also varies. The combined correction factor can be as much as ±8% of flow. Again, to restore preselected combustion conditions, the calibration of either the fuel control device or the air control device must be changed by a corresponding percentage correction factor at all firing rates.

To improve the efficiency of combustion devices, others have placed an exhaust gas analyzer in the exhaust flue after the combustion area. When the analysis of the combustion gases was out of a predetermined range or specification, the prior art devices increased or decreased the air flow rate until the combustion gases obtained a preselected specification. More specifically, prior art devices changed the air-fuel relationship by adding or subtracting an offset between the fuel flow rate and air flow rate. The detrimental effect of using an offset type of corrective action instead of percentage of flow corrective action can readily be illustrated by an example.

Assume a burner operating efficiently at a low firing rate requiring 25 cubic feet of air per minute. Assume that the fuel supply is switched to another source which contains 10% more combustibles for the same apparent fuel flow rate. The calibration imposed on the air control device by the offset type of combustion efficiency device is as follows:

| FIRING RATE | ORIGINAL AIR FLOW | 10% OFFSET | NEW AIR FLOW | REQUIRED AIR FLOW | AIR FLOW DEFICIT |
|---|---|---|---|---|---|
| Low | 25 CFM | +2.5 CFM | 27.5 CFM | 27.5 CFM | None |
| Mid | 60 CFM | +2.5 CFM | 62.5 CFM | 66 CFM | 3.5 CFM |
| High | 100 CFM | +2.5 CFM | 102.5 CFM | 110 CFM | 7.5 CFM |

Should the firing rate increase rapidly to high fire, there will be a deficiency of air, causing smoke and unburned fuel emission, until the combustion device can respond. In a typical boiler or heat exchanger, 10 to 30 seconds are required for the flame and exhaust gases to travel from the burner through the heat exchanger passages to the exhaust flue where the sampling for gas analysis takes place. Therefore after the firing rate change, the device cannot correct immediately for the air flow deficiency but rather requires at least 10 seconds before starting to correct for the air flow deficiency. If the firing rate then changes again, another cycle of incorrect calibration and necessary recalibration corrective action is initiated. With every change in the firing rate, recalibration is required because the offset correction to the calibration is mathematically incorrect. Further, inherent time lag precludes fast corrective action and under changing firing rate causes the corrective action to be based on an obsolete exhaust gas analysis. Such prior art combustion efficiency improving devices which add an offset to the air flow rate are illustrated in U.S. Pat. No. 3,549,089, issued Dec. 22, 1970 to B. E. Hamlett and Pat. No. 3,814,570 issued June, 1974 to F. Guigues et al.

A primary disadvantage of the prior art devices is that the air-fuel ratio must be recalibrated and readjusted with every change in the firing rate or burner load, and that the recalibration and readjustment lag the load change.

SUMMARY OF THE INVENTION

The present invention contemplates a new and improved combustion control apparatus which overcomes the above referenced problems and others. It provides a combustion control apparatus which changes or recalibrates the air-fuel flow relationship of the combustion device by a percentage over all burner firing rates rather than by an offset which must be recalibrated with each firing rate change.

In accordance with the invention, there is provided an efficiency improving apparatus for combustion apparati of the type which have a combustion chamber, a fuel supply rate regulating means, an air supply rate regulating means, a jackshaft which is rotatable such that its angular position controls combustion load, and a mechanical linkage for interconnecting the jackshaft with the fuel and air supply regulating means such that the fuel and air supply rates are constrained to a preselected set air-fuel relationship and such that rotation of the jackshaft changes the fuel and air supply rates while maintaining the preselected air-fuel relationship. The efficiency improving apparatus includes an exhaust gas analyzing means which is adapted to analyze at least a part of the exhaust gases from the combustion chamber, means for comparing the exhaust gas analysis with a preselected analysis, and adjusting means operatively connected with the mechanical linkage and the comparing means for adjusting the preselected air-fuel relationship by a percentage. In this manner, the air flow to fuel flow relationship is adjusted by the same percentage over all combustion firing rates from the minimum to the maximum load.

In accordance with a more limited aspect of the invention, the efficiency improving apparatus adjusting means includes a first shaft which is connected by the mechanical linkage with the jackshaft to be angularly displaced therewith. A second shaft is connected by the mechanical linkage with one of the air supply regulating means or the fuel supply regulating means such that the angular displacement thereof controls the supply rate. An angular displacement means interconnects the first and second shafts such that angular diplacement of the first shaft causes a corresponding angular displacement of the second shaft. The angular displacement means provides an effective gear ratio between the first and second shaft. A ratio adjusting means which is connected with the comparing means adjusts the effective gear ratio by a percentage in response to the exhaust gas analysis differing from the preselected analysis. In this manner, adjusting the gear ratio changes the air-fuel volume relationship by the same percentage over all combustion loads.

In accordance with a more limited aspect of the invention, the efficiency improving apparatus is combined with a combustion apparatus.

A principle advantage of the invention is that it improves the efficiency of combustion devices. The invention reduces the amount of fuel consumed by a combustion device to produce the same amount of output energy or heat. Stated alternately, the present invention enables combustion devices to produce more output energy or heat from a given amount of fuel.

Another advantage of the present invention is that it helps reduce pollution by combusting fuels more completely and efficiently, particularly during rapid changes in the firing rate.

Another advantage of the present invention is that it automatically recalibrates the linkage interconnecting the combustion air supply control device and the fuel supply control device to compensate for variations in the oxygen content per unit volume of air supplied, and/or for variations in the combustibles content per unit volume of fuel supplied, so that for any rapid change in firing rate, the rate of air flow relative to fuel flow is instantly positioned to provide the preselected correct combustion condition. This is because the linkage calibration is kept continually updated to compensate for variations in fuel and air quality as they occur over a period of time.

Another advantage is that it automatically adjusts the combustion reaction in response to changes in fuel, air, or burner conditions.

Still further advantages of the present invention will become apparent to others upon reading and understanding the following detailed description of the preferred embodiment.

BRIEF DESCRIPTION OF THE FIGURES

The invention may take form in various parts and arrangements of parts. The drawings are only for purposes of illustrating preferred and alternate embodiments and are not to be construed as limiting the invention.

DESCRIPTION OF THE PREFERRED EMBODIMENT

Figure 1:
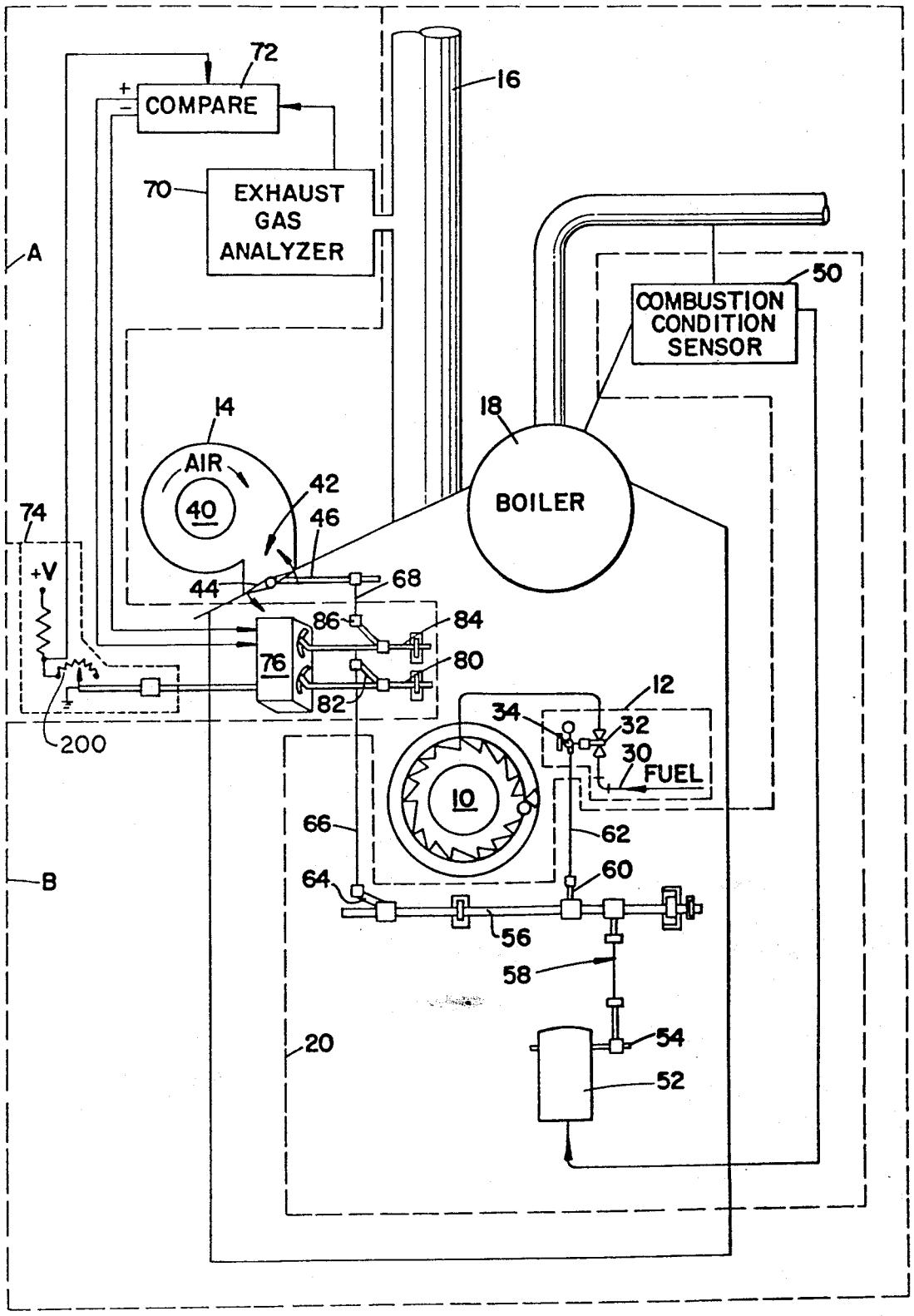
FIG. 1 is a schematic representation of an efficiency improving apparatus in accordance with the present invention in combination with a combustion device.

FIG. 1 illustrates an efficiency improving apparatus A in combination with a combustion apparatus B. The combustion apparatus includes a combustion chamber 10 in which a combustion reaction takes place. In the combustion reaction, a fuel such as fuel oil, natural gas, coal, or the like is oxidized to produce energy, particularly heat. Fuel is supplied to the combustion chamber 10 by a fuel supply means 12. Fuel supply means 12 is illustrated as a fluid fuel supply. However, it will be appreciated that analogous structures can be provided to supply fuel in other forms, e.g. an auger may supply coal in particulate form at controllable rates. An air supply means 14 supplies air to the combustion chamber. In the preferred embodiment, the air supply means is a blower which forces air into the combustion chamber under pressure. The combustion reaction in which the fuel is oxidized in the combustion chamber produces various combustion by-products, principally in the form of exhaust gases. These exhaust gases are conveyed from the combustion chamber 10 by a chimney or exhaust flue 16. The exhaust gases generally include carbon dioxide, carbon monoxide, water vapor, free oxygen, unoxidized fuel vapors, and the like. The heat or other energy produced in the combustion chamber is commonly used for an industrial useful purpose. For example, the heat may be used to boil water in a boiler 18 to produce steam. Alternately the heat may be used for other purposes, such as in an oven or the like.

The combustion apparatus also includes a combustion or firing rate control means 20 for controlling the combustion load or firing rate, i.e. the rate at which fuel and air are supplied to combustion chamber 10. The combustion control means is responsive to firing rate demands on the combustion apparatus to increase or decrease the rate at which energy is produced. To control the rate at which energy is produced, the combustion control means controls the rate at which fuel and air are supplied to the combustion chamber. The combustion control means directly controls either the fuel supply rate or the air supply rate with the other being constrained in accordance with a predetermined fixed relationship to the first supply rate, i.e. predetermined air-fuel relationship.

The fuel supply means 12 comprises an input fuel line 30 which carries liquid or gaseous fuel under generally a prescribed pressure. The fuel supply means further includes a fuel regulating means 32 for regulating the rate at which fuel is supplied to the combustion chamber. The fuel regulating means 32 may be a flow regulating valve which is operated by angular displacement of a lever 34 to control the fuel flow rate.

The air supply means 14 comprises a blower 40 for producing air under a generally predetermined pressure. The air supply means further includes an air regulating means 42 for regulating the rate at which air from the blower 40 is supplied to the combustion chamber. In the preferred embodiment the air regulating means 42 is a baffle 44 which is rotated in an air duct by a lever 46. The angular position of lever 46 determines the position of baffle 44 and, hence, the amount of obstruction which baffle 44 provides across the air supply duct.

The combustion control means 20 includes a combustion conditioned sensor 50 for sensing a predetermined combustion condition, such as temperature, steam pressure, or the like. The combustion condition sensor may be a pressure sensor, thermocouple, or the like. When the sensed combustion condition varies more than a predetermined amount above or below a preselected combustion condition level or firing rate, a drive motor 52 is actuated by the combustion condition sensor 50 to rotate a shaft 54. The direction in which the shaft 54 is rotated is determined by whether the sensed combustion condition is above or below the preselected level. The drive motor 52 may rotate the shaft 54 by a fixed incremental amount, allow the combustion chamber to stabilize, and resample the combustion sensor 50 to determine whether the fixed amount of change has brought the combustion condition or firing rate within the predetermined level. If the sensed combustion condition is not at the preselected level, the drive motor 52 may again rotate the shaft 54 a fixed incremental amount. Alternately, the combustion condition sensor 50 may include means to determine the amount of divergence between the preselected level and the sensed level and actuate the drive motor 52 to rotate the shaft 54 by a corresponding angular amount. The shaft 54 is connected to a jackshaft 56 by a mechanical linkage 58. The mechanical linkage 58 causes the jackshaft 56 to rotate by an amount corresponding to the angular displacement of the shaft 54. Thus, the angular position of the jackshaft corresponds to the selected firing rate and the angular displacement or change of angular position corresponds to the selected change in the firing rate or combustion load. Although illustrated as a single rod, it is to be appreciated that the jackshaft may also be constructed as a plurality of rods which are connected to undergo common rotation.

The combustion control means 20 is connected with the fuel regulating means 32 and the air regulating means 42. A mechnical linkage connects the jackshaft with the fuel and air regulating means such that rotation of the jackshaft causes a corresponding change in the air and fuel supply rates but which maintains the predetermined air-fuel volume relationship. The mechanical linkage includes a lever 60 connected to the jackshaft 56 for angular displacement therewith, the lever 34, and a connecting link 62 which connects the lever 60 with the lever 34. The mechanical linkage further includes a lever 64 connected to the jackshaft for angular displacement therewith, the lever 46, and the links 66 and 68 which connect the lever 64 with the lever 46. The efficiency improving apparatus A is connected with the mechanical linkage to change the air-fuel volume relationship by a percentage. That is, the air to fuel supply rates are adjusted from the preselected air-fuel volume relationship by the same percentage over all combustion loads. To install the efficiency improving apparatus in a prior art combustion apparatus, the link which would have connected levers 46 and 64 is removed and replaced with the link 66 which connects the jackshaft with the efficiency improving apparatus and the link 68 which connects the efficiency improving apparatus with one of the air and fuel regulating means, in the preferred embodiment the air regulating means. Alternately, the efficiency improving apparatus A may be interconnected with the connecting link 62 which also enables the predetermined air to fuel volume relationship to be altered by the selectable percentage.

The efficiency improving apparatus A includes an exhaust gas analyzing means 70 which is connected with exhaust stack 16 for analyzing the exhaust gases from the combustion chamber. The analyzer may determine the amount or concentration of carbon monoxide, unburned fuel, free oxygen, or other combustion by-products. In the preferred embodiment, the concentration of free oxygen ($O_2$) is sensed. A suitable exhaust gas analyzing means is a Thermox WDG-III Oxygen Analyzer. This analyzer measures the concentration of free oxygen in the exhaust flue 16. For each firing rate or fuel supply rate, there is a determinable concentration of free oxygen which indicates an optimal efficient operation of the combustion chamber. The amount of oxygen which indicates the optimal efficiency of the combustion chamber is not, however, the same for each fuel supply rate or firing rate. Concentrations of free oxygen which are typical of efficient combustion vary from about two percent at high firing rates to about five percent at low firing rates. The optimal oxygen or other exhaust gas analyses may vary with the specific combustion device. The optimal oxygen concentration analysis for a specific combustion device may be determined by adjusting the air supply rate at each of several firing rates over the low to high firing rate range until a suitably efficient combustion reaction is obtained while measuring the free oxygen concentration at each firing rate. The efficient oxygen concentration analysis may be extrapolated into a relationship, expressible as a free oxygen versus firing rate curve, between firing rate or fuel supply rate and the concentration of free oxygen in the exhaust flue. A comparing means 72 compares the results of the oxygen or exhaust gas analysis performed by the analyzer 70 with a preselected, efficient analysis. As a result of the comparison, the comparing means 72 produces a signal indicating whether the air flow supply rate relative to the fuel supply rate is to remain unchanged or is to be altered by increasing or decreasing the predetermined air-fuel relationship by a selectable percentage. The preselected efficient analysis is supplied to the comparing means 72 by a preselected analysis indicating means 74. The preselected analysis indicating means is an electromechanical device which is interconnected directly or indirectly, with the jackshaft 56 to receive a mechanical input which varies with the selected firing rate and with the comparator 72 to supply an electrical output which varies as a function of the free oxygen versus firing rate curve. The preselected analysis indicating means may take numerous others forms. For example, a digital encoder disposed for rotation with the jackshaft 56 may address a programmable read only memory which is preprogrammed to supply a preselected electrical value for each angular disposition of the jackshaft in accordance with the preselected free oxygen versus firing rate curve.

The signal from the comparator 72 controls an electromechanical or continuously variable transmission means 76 for adjusting the relationship between the air supply rate and the fuel supply rate, particularly the air to fuel volume relationship, by a predetermined percentage. As illustrated in FIG. 1, the electromechanical means 76 adjusts the air supply rate relative to the fuel supply rate that is set by the combustion control means 20. In the alternate embodiment in which the electromechanical means 76 is interposed in the link 62, it adjusts the fuel supply rate relative to the air supply rate that is set by the combustion control means 20. The electromechanical means 76 includes a first shaft 80 which is connected to the jackshaft 56 by a lever 82, the link 66 and the lever 64. Because the jackshaft 56 and first shaft 80 rotate together, the shaft 80 is, in a sense, redundant. However, it has been found that this simplifies adding the efficiency improving apparatus to existing combustion apparatus. It will be understood that first shaft 80 may be an integral part of the jackshaft. A second shaft 84 is connected with the air supply regulating means by a lever 86, the link 68 and the lever 46. The electromechanical continuously variable transmission means 76 connects the first and second shafts.

Figure 2:
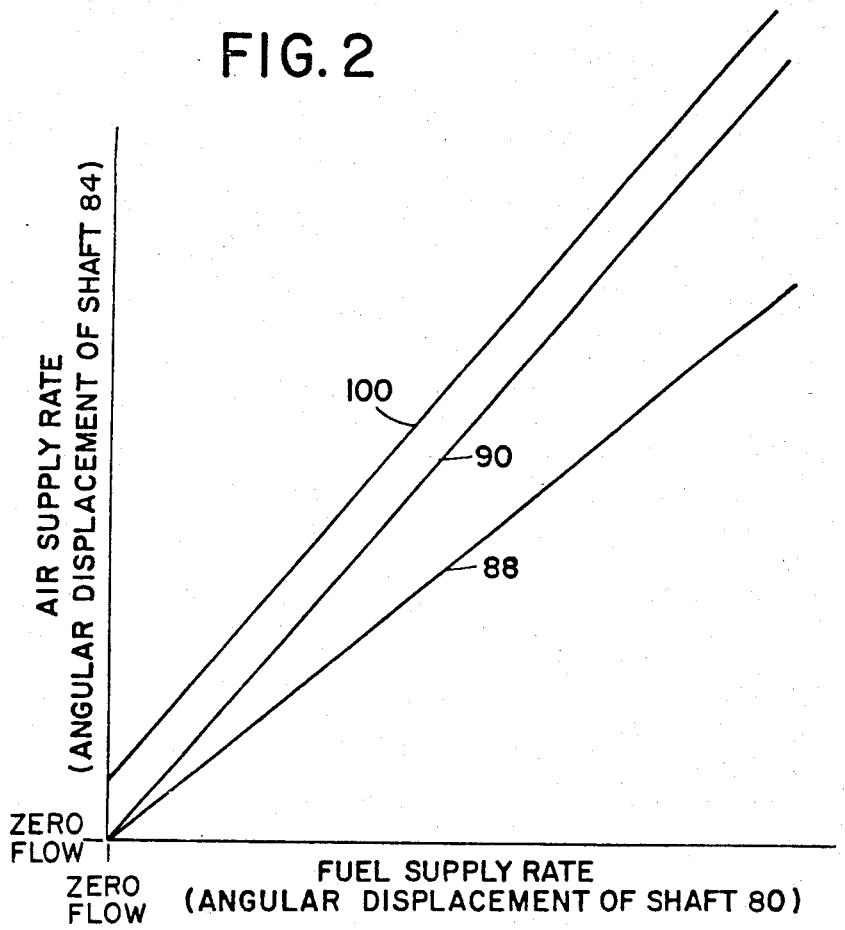
FIG. 2 is a graphic representation illustrating adjustments to the air-fuel relationship in accordance with the present invention.

With reference to FIG. 2, a typical predetermined air-fuel relationship is illustrated by curve 88. This curve 88 may be achieved by connecting the lever 64 directly with the lever 46 or by adjusting the continuously variable transmission means to provide a 1:1 gear ratio between the angular displacement of the first shaft 80 and the second shaft 84. A curve 90 illustrates the air to fuel relationship of the curve 88 increased by a percentage. Note that the percentage increase causes the curve 90 to intersect the curve 88 at the origin, or zero flow rate. The curves 88 and 90 vary only in slope.

The phrase "angular displacement" herein connotes the amount of rotation of a solid body about its axis. When used in conjunction with a shaft, the angular displacement denotes the amount of rotation of the shaft about its axis.

Figure 3:
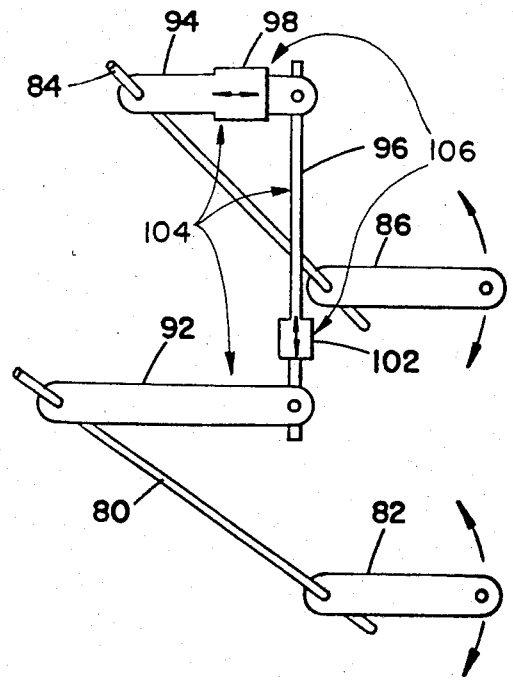
FIG. 3 is a schematic representation of the mechanical part of an efficiency improving apparatus in accordance with the present invention.

With reference to FIG. 3, the electromechanical continuously variable transmission means 76 includes an adjustable angular displacement means 104 for angularly displacing the second shaft 84 in a set ratio to the angular displacement of the first shaft 80 and a ratio adjusting means 106 for adjusting the ratio of the angular displacement of the first shaft to the angular displacement of the second shaft by a percentage. Thus, when the efficiency improving apparatus is combined with a combustion device, the mechanical continuously variable transmission means is a means for altering the set air to fuel volume relationship by a percentage.

The angular displacement means 104 includes a first lever arm 92 which is connected to be angularly displaced with the first shaft 80. A second lever arm 94 is connected to be angularly displaced with the second shaft 84. A connecting link 96 is pivotally connected with the first and second lever arms. Thus, rotating the first shaft 80 causes second shaft 84 to rotate in the set gear ratio. The exact gear ratio of the continuously variable transmission means, i.e. the relative angular displacement of the two shafts, is determined by the effective lengths of the lever arms 92 and 94 and the connecting link 96. To change the gear or angular displacement ratio, the gear or angular displacement ratio changing means 106 is provided. The ratio changing means 106 includes a means 98 for changing the effective length of one of lever arms 92 and 94. Simple geometry, however, dictates that lengthening one of the lever arms causes an offset in the angular displacement of second shaft 84. Thus, as indicated by a curve 100 of FIG. 2, increasing the effective length of lever arm 94 changes the ratio between shafts 80 and 84 by a percentage plus an offset. With the positive offset illustrated by the curve 100, an air supply is provided even when the fuel supply is terminated. Analogously, with a negative offset in the air-fuel ratio at a very low combustion load, fuel is supplied when no air is supplied. To remove the offset, i.e., shift curve 100 down to intersect the origin, the ratio changing means further includes a means 102 for changing the effective length of connecting link 96.

Figure 4:
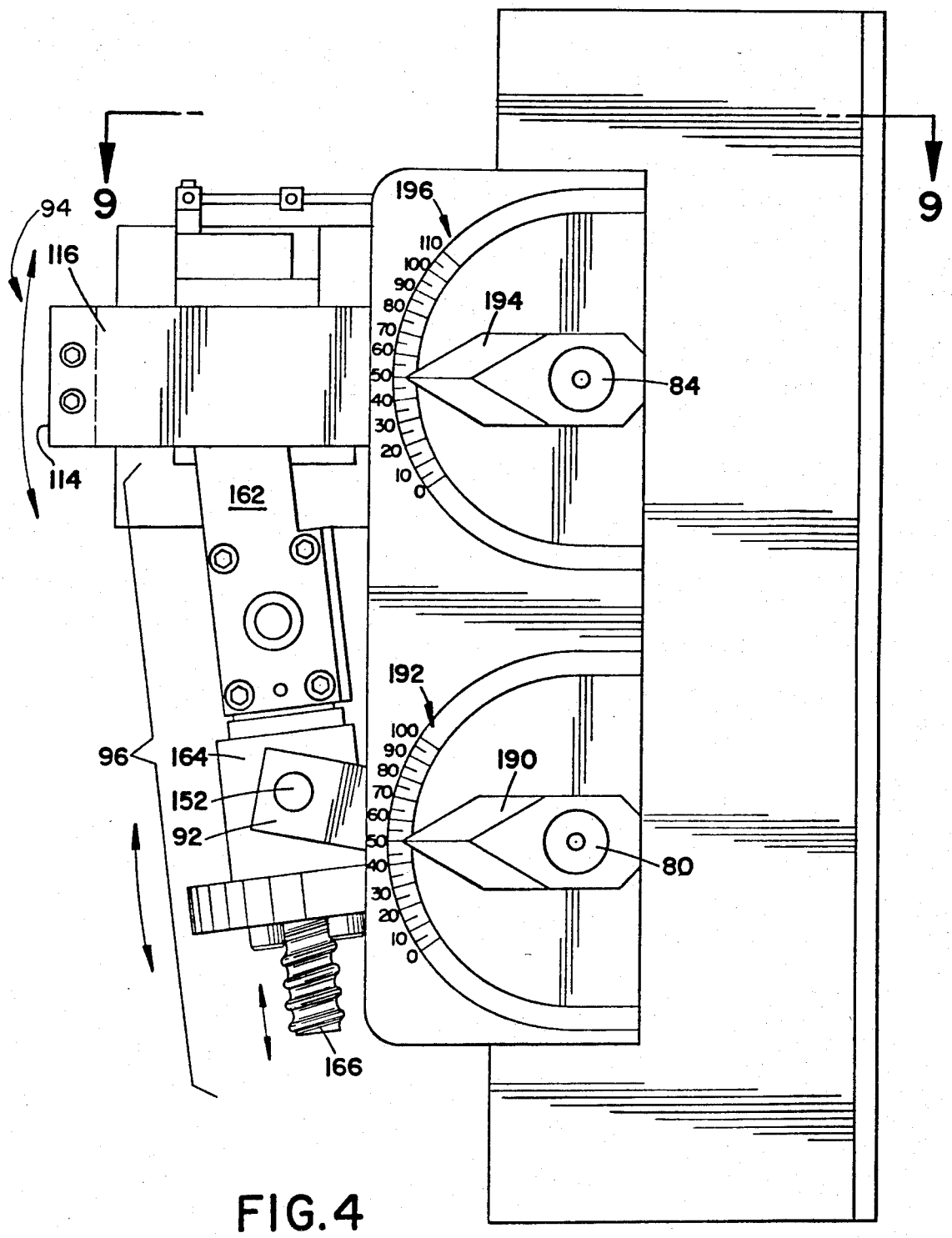
FIG. 4 is a side elevational view of a first embodiment of an efficiency improving apparatus in accordance with the present invention.
Figure 5:
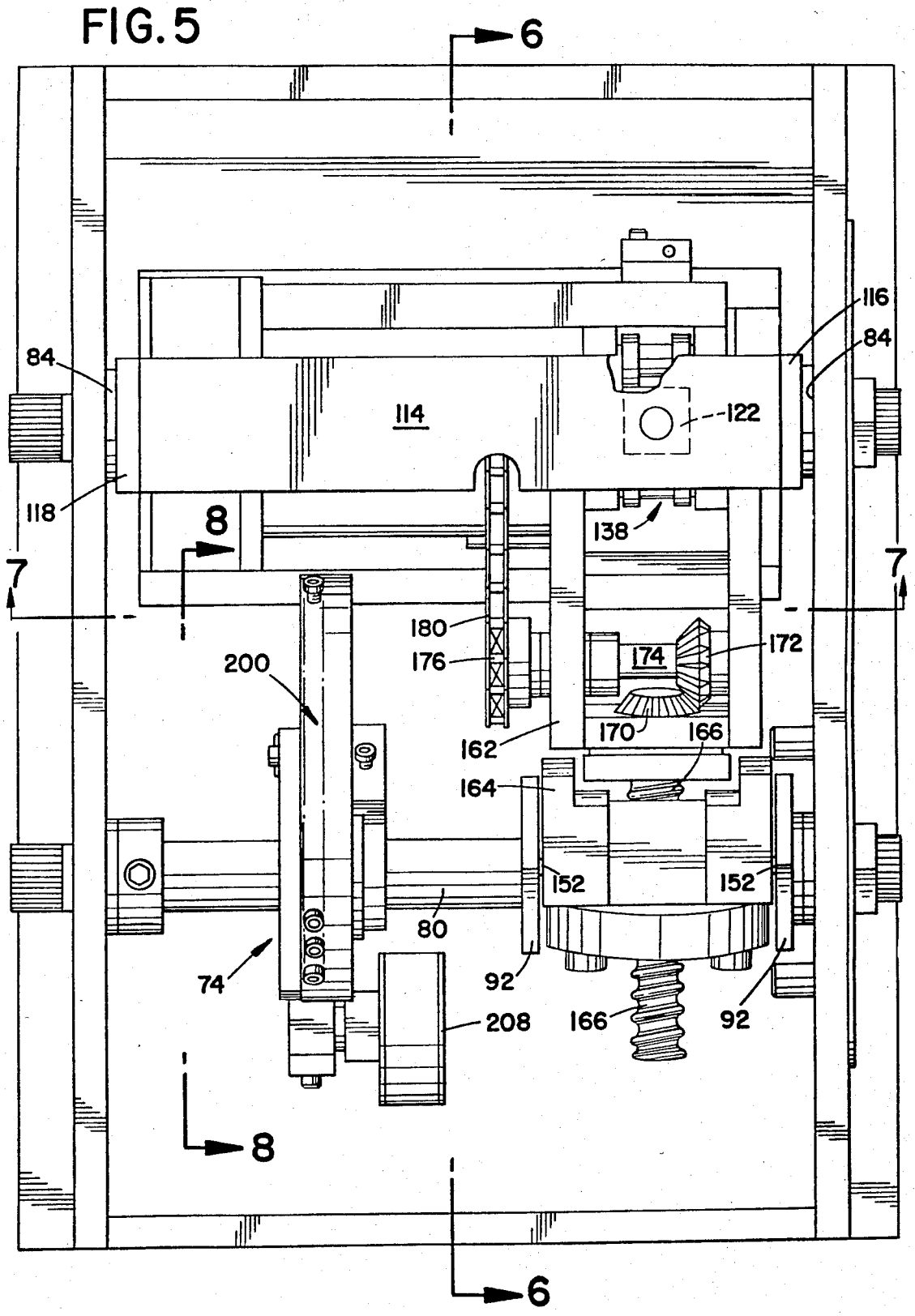
FIG. 5 is a top view of the apparatus of FIG. 4.

The first embodiment of the continuously variable transmission means 76 is illustrated in FIGS. 4–9. With particular reference to FIGS. 4 and 5, the first lever arm 92 is a pair of parallel plates which are attached to the first shaft 80 for angular displacement therewith.

The second lever arm 94 which rotates with the second shaft 84 includes an open four-sided generally rectangular frame comprising a frame base 112, a frame top 114, and a pair of frame sides 116 and 118. In the preferred embodiment, the second shaft 84 is a plurality of elements connected for common rotational movement.

Figure 6:
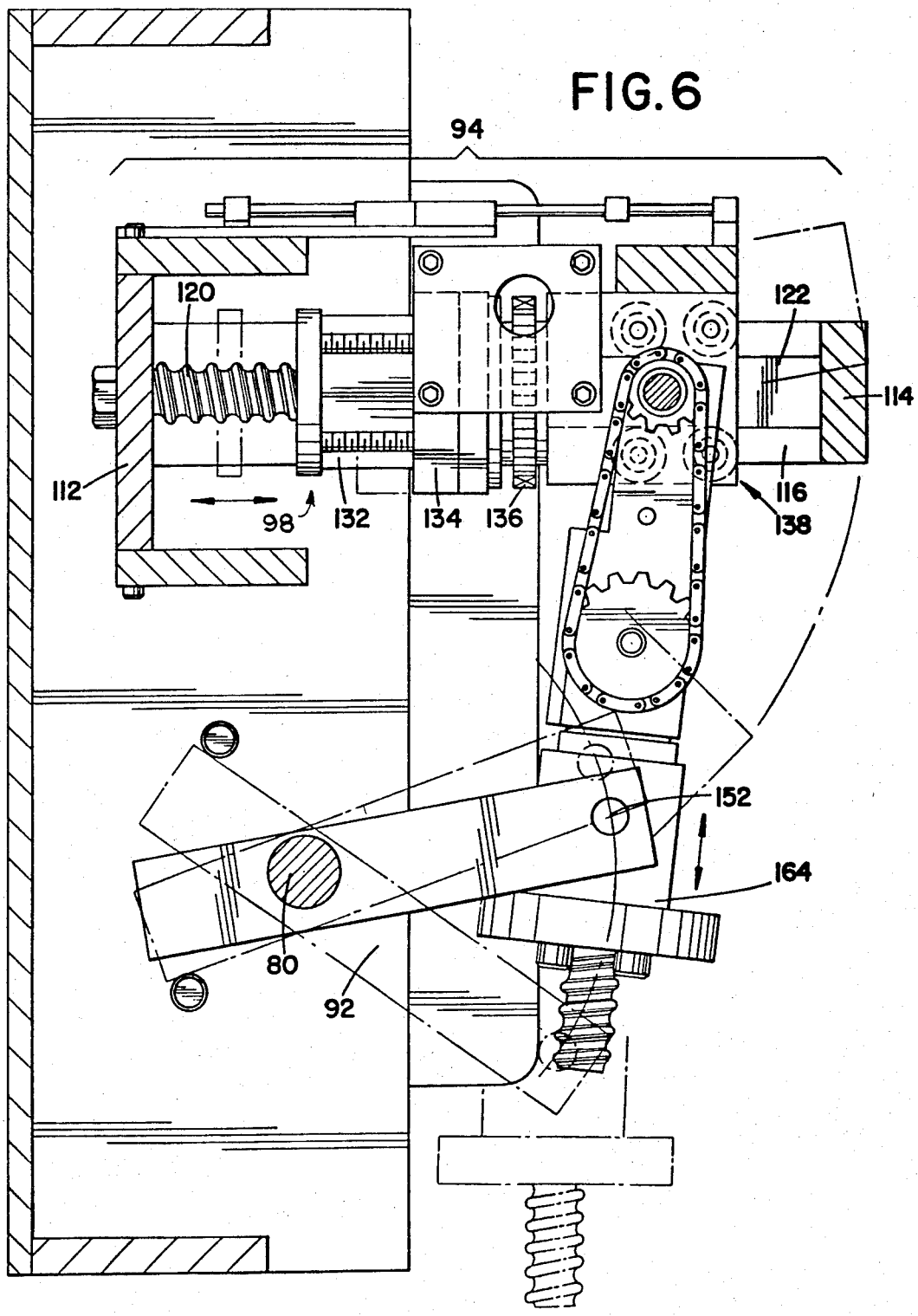
FIG. 6 is a sectional elevation through section 6—6 of FIG. 5.
Figure 7:
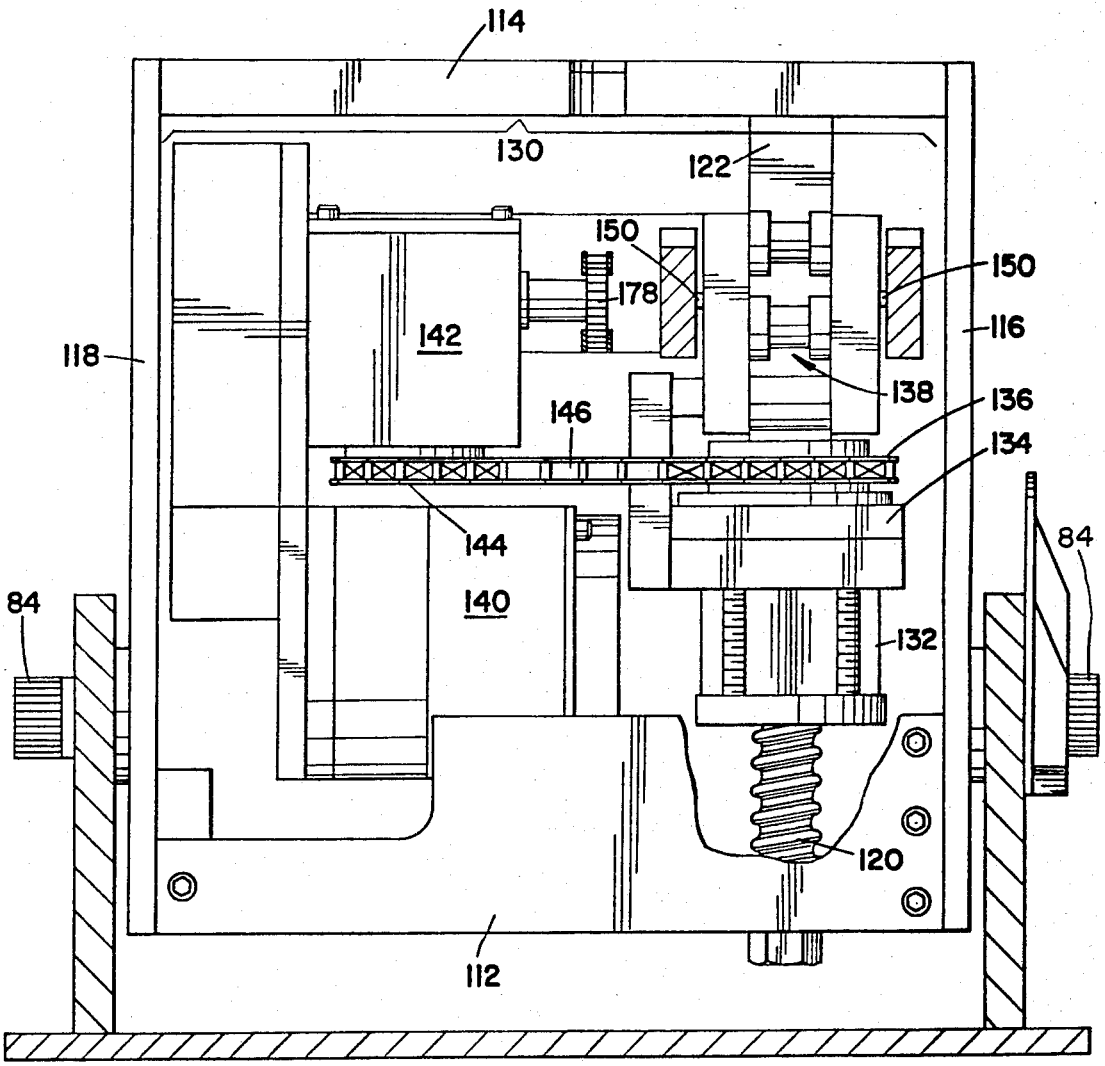
FIG. 7 is a sectional elevation through section 7—7 of FIG. 5.

With particular reference to FIGS. 6 and 7, the second lever arm effective length changing means 98 of the ratio changing means includes a screw threaded segment 120 which is rigidly connected to the frame base 112. The screw threaded segment 120 is disposed parallel to the central axis of the second lever arm 94. The screw threaded segment has a length which is commensurate with the maximum change in the length of the second lever arm. Connected between the screw threaded segment 120 and the frame top 114 is a rigid bar 122. The bar 122 is coaxial with the screw thread segment 120. The bar 122 acts as a guide means for a follower 130 which is movable parallel to frame side walls 116 and 118, i.e., the central axis of the second lever arm, toward frame top wall 114 or toward frame bottom wall 112. The follower 130 comprises means 132 for engaging the screw thread segment 120. The screw thread engaging means 132 comprises a sleeve which surrounds the screw thread segment 120 and which is rotatably journalled in a stationary segment 134 of the follower 130. A sprocket 136 is connected with the sleeve for rotating it selectively in a clockwise or counterclockwise direction. The sleeve 132 may be threaded on its interior to match the threads of the screw thread means 120 or may include a ball or other means for engaging and riding on the screw threads of the screw thread means 120 whereby rotating sleeve 132 causes the follower to move along the axis of the screw thread segment 120. A plurality of rollers 138 engage the guide means 122 to enable the follower to slide smoothly and easily along it.

With particular reference to FIG. 7, the ratio changing means further includes a reversible motor 140 and a gear box 142 which are mounted on the follower. The gear box 142 is connected with a first sprocket 144 which is connected by a chain drive 146 with the sprocket 136. The reversible motor 140 can be actuated to rotate in either direction to move the follower 130 in either direction along the axis of the second lever arm 94. Also disposed in the follower 130 substantially perpendicular to the central axis of the screw thread segment 120 and the bar 122 is a pivot means 150 for connection with the connecting link 96. The effective length of the second lever arm is the distance along the axis of the screw thread segment 120 and the bar 122 between the second shaft 84 and pivot means 150. Thus, as the follower moves along the screw thread segment 120, the effective length of the second lever arm is changed.

With particular reference to FIGS. 4 and 5, the interconnecting link 96 is pivotally connected with the first lever arm 92 by the pivot means 152 and with the second lever arm 94 by the pivot means 150. The interconnectng link comprises a first non-rotatable connecting link segment 162 which is pivotally connected with the second lever arm 94 and a second non-rotatable connecting link segment 164 which is pivotally connected with the first lever arm 92. The connecting link length changing means 102 of the ratio changing means 106 includes a helically threaded shaft 166 which is rotatably journalled in the first link segment 162 and threadingly engages the second link segment 164. When the helically threaded shaft 166 is rotated, the second connecting link segment 164 moves axially along the helically threaded shaft relative to the first connecting link segment 162. Attached to the helically threaded shaft 166 for rotation therewith is a first bevel gear 170. Disposed in meshing engagement with the first bevel gear 170 is a second bevel gear 172. The second bevel gear 172 is mounted on a bevel gear drive shaft 174 which is rotatably journalled in the first link segment. Connected with the bevel gear drive shaft 174 is a sprocket 176. The bevel gears 170 and 172, the driveshaft 174 and the sprocket 176 include means for rotating the helically threaded shaft 166. The sprocket 176 is connected with a sprocket 178 connected with the gear box 142 by a chain 180. The axis of the sprocket 178 (FIG. 7) is coaxial with the pivot means 150, whereby the distance between the sprockets 176 and 178 remains unchanged as the effective length of the second lever arm is changed.

Rotation of the motor 140 simultaneously and in a predetermined relationship changes the effective length of the second lever arm and the interconnecting link. The exact nature of this fixed relationship is determined by the gear ratios in gear box 142 and the relative diameters of sprockets 136, 144, 176, and 178. It will be appreciated that gear trains, gear belt drives, and the like may be substituted for the chain and sprocket drives. The relationship between these gears is selected, as discussed in connection with FIG. 2, to change the angular displacement ratio between the shafts 80 and 84 by a percentage and without an offset.

With particular reference to FIGS. 4 and 7, connected with the first shaft 80 and the second shaft 84 are means for indicating the relative shaft positions of the first and second shafts. There is a pointer 190 connected to the first shaft 80 for rotation therewith. The pointer 190 points to a scale 192. In the preferred embodiment, the scale 192 ranges, in percent, from "0" to "100" at the extremes of angular displacement of the first shaft 80. The "0" indication position of pointer 190 indicates zero combustion load or fuel supply rate. The minimum practical load or fuel supply rate may be 25 percent or 10 percent or some similar point depending on burner and equipment characteristics. Similarly, the "100" indicator position of the pointer 190 indicates the maximum load or fuel supply rate. Thus, the scale 192 is indicative of the fuel supply rate as a percentage of the maximum fuel supply rate. The scale 192 can also be viewed as a percentage of the maximum input angular displacement of the first shaft 80. Connected with the second shaft 84 is a pointer 194 which points to a scale 196. When the efficiency improving apparatus A is interposed in the air supply control linkage as shown in FIG. 1, the pointer 194 and the scale 196 indicate the air supply rate as a percentage of the maximum air supply rate when the combustion control means is connected directly to the air supply means without the means for improving the combustion efficiency, i.e. the angular displacement of the second shaft 84 as a percent of the maximum angular displacement of the first shaft 80. The pointer 194 points to "0" when the combustion device is operating at its minimum load or fuel and air supply rate. In an intermediate combustion load, the pointer 190 indicates the fuel supply rate as a percentage of the maximum fuel supply rate and the pointer 194 indicates the air supply rate as a percentage of the air supply rate which corresponds to the maximum fuel supply rate when the first and second shafts 80 and 84 are connected in a 1:1 ratio. In the preferred embodiment, the air supply rate, depending on the adjustment of the lengths of the first lever arm and the interconnecting link, may vary from about 85 to 115 percent of the air supply rate without the combustion efficiency improving apparatus A. That is, the combustion efficency improving apparatus A may vary the air supply rate corresponding to each fuel supply rate by up to plus or minus 15 percent. For example, if the air supply rate is to be increased 10 percent, at the no load position both pointers would point to "0"; at the half load position the pointer 190 would point to "50" and pointer 194 would point to "55"; and at the full load position the pointer 190 would point to "100" and the pointer 194 would point to "110". If the efficiency improving apparatus A were interposed in the fuel supply control linkage the pointer 194 and the scale 196 would indicate fuel supply rate and the pointer 190 and the scale 192 would indicate air supply rate. The same functional relations discussed above would still hold but fuel and air supply rates would be reversed.

Figure 8:
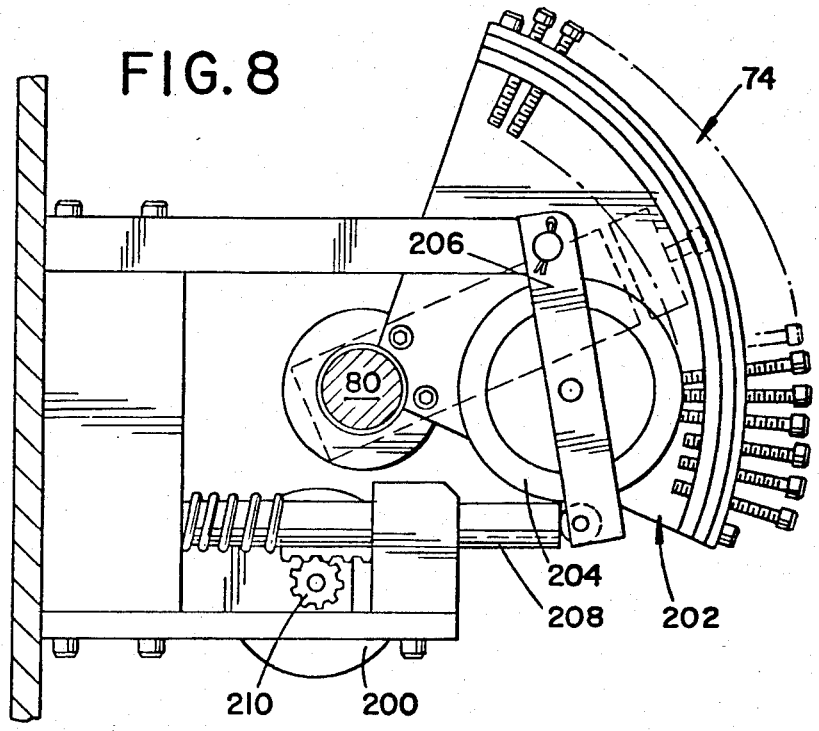
FIG. 8 is a sectional elevation through section 8—8 of FIG. 5.

With reference to FIGS. 5 and 8, the preselected analysis indicating means 74 includes a potentiometer 200 which forms a part of a voltage divider. The output voltage of the voltage divider is the preselected analysis to which the comparator 72 compares the result of the exhaust gas analysis by the analyzer 70. To match the output of the voltage divider which corresponds to the preselected free oxygen versus firing rate curve, an adjustable, non-linear gearing means is provided between the jackshaft 56 or the first shaft 80. The adjustable, non-linear gearing means includes an adjustable camming means 202 which is connected to the first shaft 80 for rotation therewith. In the preferred embodiment, the adjustable camming means 202 is a cockscomb arrangement in which a plurality of set screws define the camming surface. The adjustable camming means cams a wheel 204 which is mounted on a camming lever 206. The camming lever 206 drives a rack gear 208 which engages a pinion gear 210 mounted on the shaft of the potentiometer 200. Alternately, the shaft of the potentiometer can be rotated by a lever arm and linkage which is connected with the potentiometer shaft and shaft 80, or other well known mechanical drives. By adjusting the set screws in the cockscomb arrangement, the output of the voltage divider can be adjusted to indicate the desired oxygen analysis which corresponds to each combustion load, i.e. angular orientation of the first shaft 80. As explained above, the desired free oxygen content commonly varies from about five percent at low firing rate to about two percent at maximum firing rate. In this way, a preselectable analysis is indicated for each firing rate or fuel supply rate.

Figure 9:
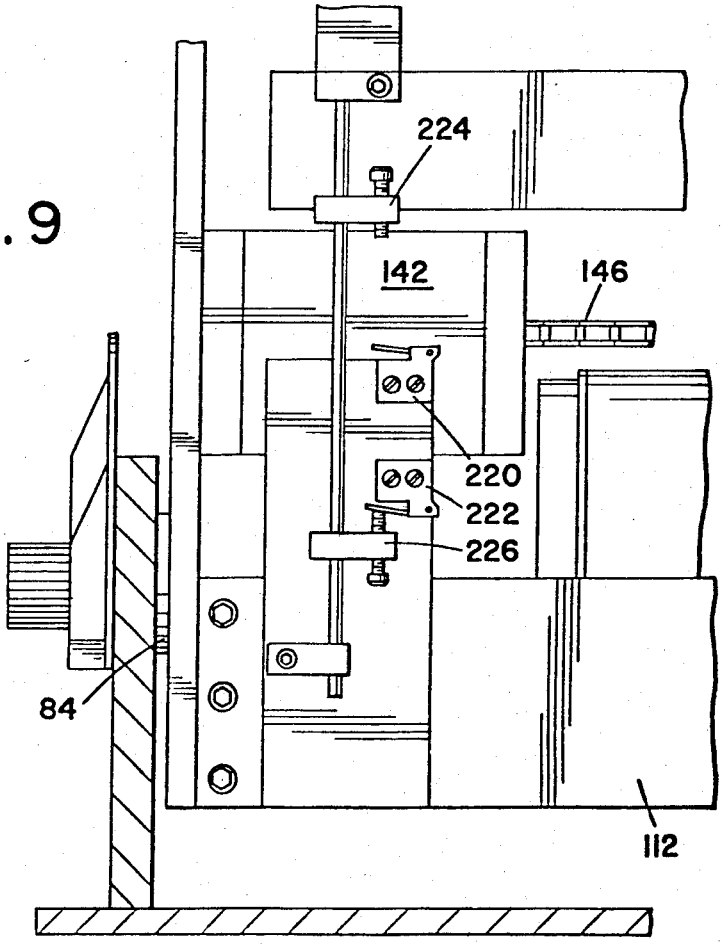
FIG. 9 is a partial side section through section 9—9 of FIG. 4.

With reference to FIG. 9, means are provided to protect the motor 140. This means includes a means for stopping the motor when it has changed the effective length of the second lever arm 94 to its maximum or minimum length. This means includes a pair of safety shut off switches 220 and 222 which are actuated by adjustable stops 224 and 226. The switches are disposed in a fixed relationship with the frame base 112. The stops are attached to the follower 130 to move parallel to the axis of the second lever arm. The stops are adjusted to actuate the switches at or before the maximum and minimum extensions of the second lever arm.

Figure 10:
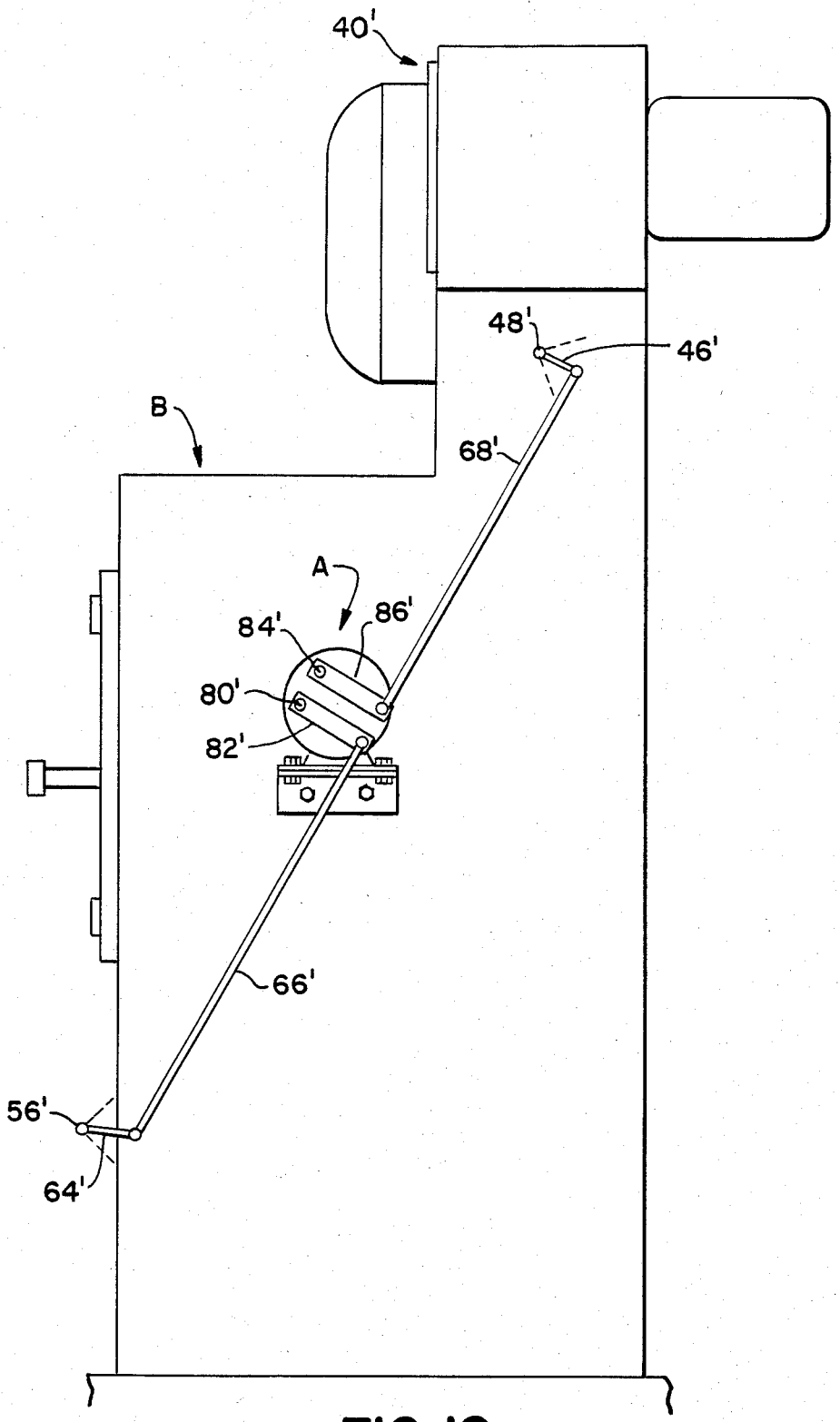
FIG. 10 is a schematic representation of another embodiment of an efficiency improving apparatus in accordance with the present invention in combination with a combustion device.

FIGS. 10 through 13 illustrate a second embodiment of the efficiency improving apparatus A. In the embodiment of FIGS. 10 though 13, like elements with the elements of the embodiment of FIGS. 1 through 9 are denoted with the same reference numeral followed by a prime (′). With particular reference to FIG. 10, there is illustrated an efficiency improving apparatus A in accordance with the present invention in combination with a combustion apparatus B. The combustion apparatus includes a jackshaft 56′ whose angular position controls the fuel supply rate and air supply rate to the combustion apparatus. Specifically, connected with the jackshaft 56′ there is a lever 64′ which is rotated with the jackshaft to move an air supply connecting link 66′ to provide a mechanical indication of the air supply rate. The air supply link 66′ is connected with the efficiency improving apparatus A which in turn is connected by a second air supply link 68′ to an air supply lever 46′ whose angular position controls the actual air supply rate. The efficiency improving apparatus A adjusts the air to fuel volume relationship by a percentage by increasing or decreasing the air supply rate by a percentage. For example, the efficiency improving apparatus A may increase the air to fuel volume relationship ten percent by increasing each air supply rate ten percent. Continuing the example, when the jackshaft rotates 40° with the ten percent air-fuel ratio increase, the air supply control shaft 48′ is rotated 44°; similarly when the jackshaft rotates 10°, the air supply control rate shaft 48′ is rotated 11°. Thus, the air supply rate is increased by ten percent over all firing rates.

Figure 11:
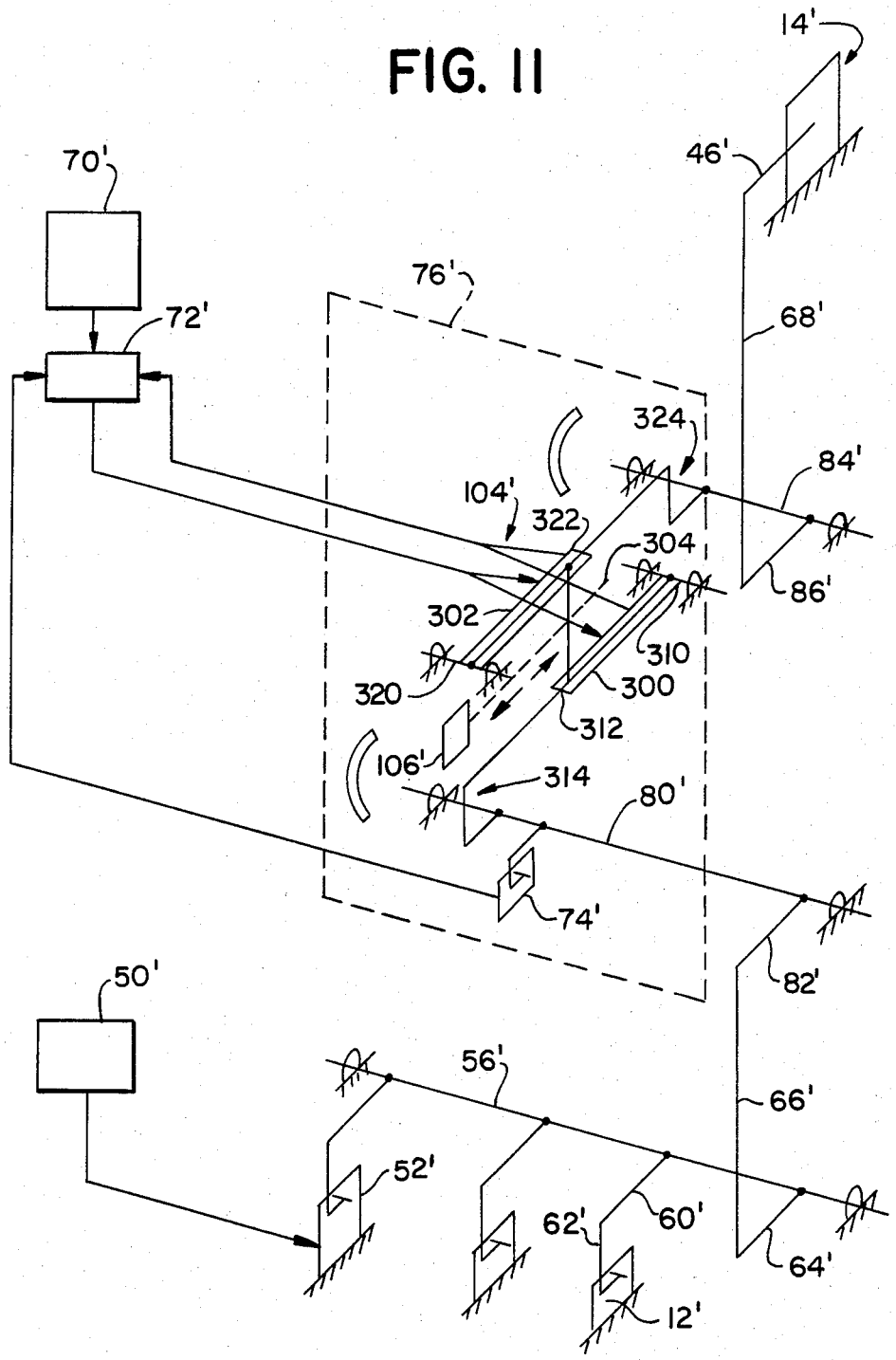
FIG. 11 is a schematic representation of the efficiency improving apparatus of FIG. 10.

With reference to FIG. 11, a continuously variable transmission means 76′ of the efficiency improving apparatus A includes an angular displacement means 104′ and a ratio changing means 106′. The angular displacement means includes a first or driving pivotal member 300 and a second or driven pivotal member 302. A movable transfer member 304 transfers the driving motion from the driving pivotal member 300 to the driven pivotal member 302. The ratio changing means 106′ transversely moves the physical position of the transfer member 304 which changes mechanical advantage between the driven and driving members, i.e. the effective gear ratio. More specifically, the driving pivotal member is pivotally mounted at a pivot or first end 310 and is connected at a free or second end 312 with the first or input shaft 80′. The first pivotal member free end 312 is connected with the input shaft by a first mechanical assembly 314 including linkage or cams which moves the first pivotal member free end toward and away from the second pivotal member 302 by an amount which is proportional to rotation of the input shaft 80′. The second pivotal member is pivotally mounted at a pivotal or first end 320 and connected at a free or second end 322 with the second or output shaft 84′. The second pivotal member free end 322 is connected by a second mechanical assembly 324 with the output shaft 84′ such that movement of the second pivotal member toward and away from the first pivotal member causes a proportional rotation of the output shaft 84′. To maintain linearity, the first and second pivotal members are mounted with their pivot ends oppositely disposed and to assume a parallel relationship around the zero firing rate end of the its range. Thus, it can be seen that as a transfer member 304 is moved toward the first pivotal member free end 312, a given rotation of the input shaft 80′ causes a larger longitudinal movement of the transfer member and as the transfer member is moved toward the first pivotal member pivot end, the given rotation causes a smaller longitudinal movement of the transfer member. Analogously, when the transfer member is disposed closer to the second pivotal member pivot end 320, a given longitudinal movement of the transfer member moves the second pivot member free end 322 a larger distance and when the transfer member is disposed closer to the second pivotal member free end, the given longitudinal movement moves the second pivotal member free end a smaller distance. Because the first and second members have their pivot ends oppositely disposed, moving the transfer member 304 toward the first pivotal member free end 312 also moves it toward the second pivotal member pivot end 320. This increases the gear ratio or mechanical advantage between rotation of the input shaft 80′ and the output shaft 84′. Analogously, when the transfer member is moved toward the first pivotal member pivot end 310 and second pivotal member free end 322, the gear ratio or mechanical advantage is decreased. Because the first and second pivotal members are disposed substantially parallel at zero firing rate, transverse movement of the transfer member does not move the second pivotal member or the second shaft 84'. That is, adjusting the gear ratio by transversely moving the transfer member introduces no offset in the relative position of the input shaft 80' and the output shaft 84'.

Figure 13:
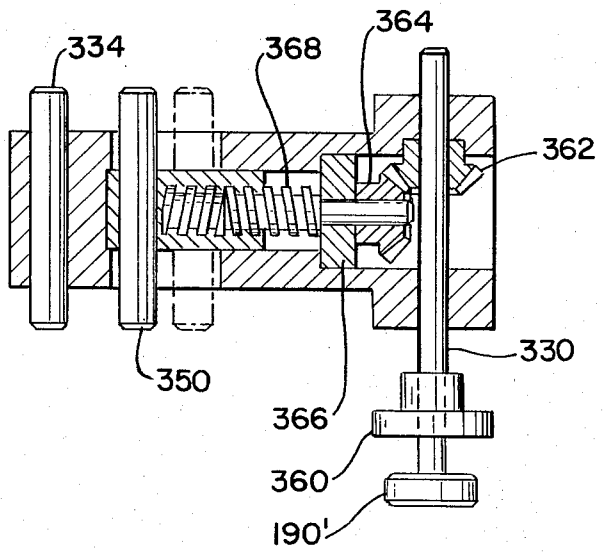
Figure 12:
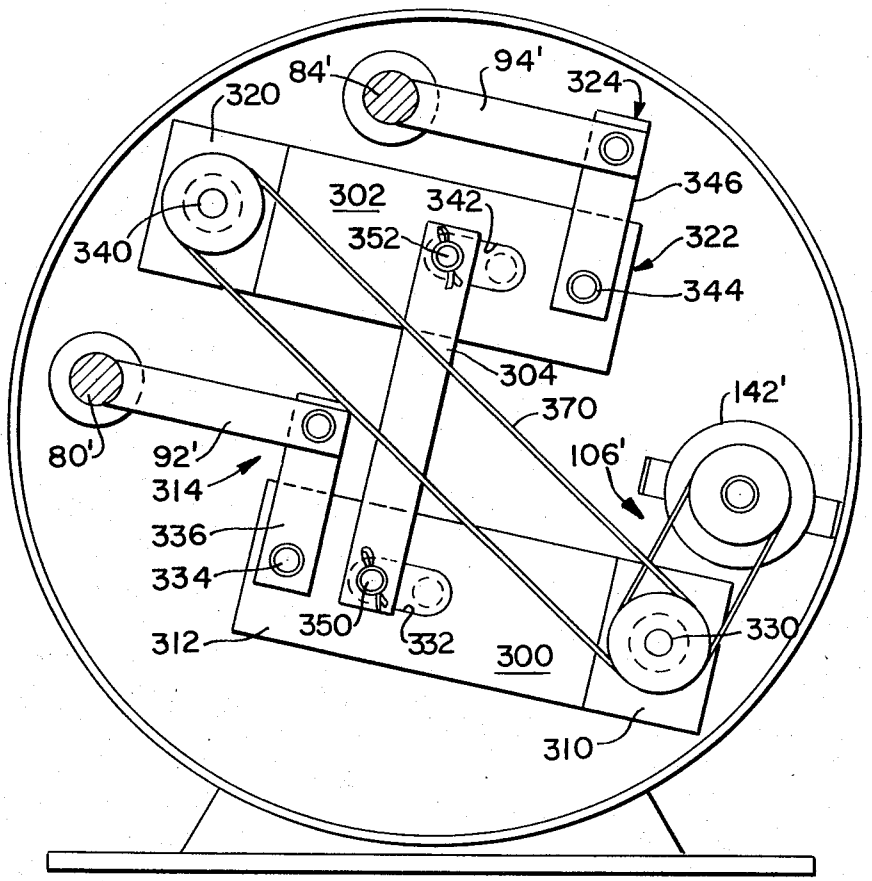
FIG. 12 is a side view of a mechanism for changing the air-fuel ratio in the embodiment of FIG. 10; and, FIG. 13 is a detailed view of one of the adjustable pivot arms of the efficiency improving apparatus of FIG. 12.

With reference to FIGS. 12 and 13, a more detailed view of the efficiency improving means A is provided. The first pivotal member 300 is pivotally mounted on a pivot shaft 330 at its first or pivotal end 310. The first pivotal means has a first elongated longitudinal slot 332 which is adapted to receive the transfer member 304. The first pivotal member further has a pivot pin 334 disposed at its free end for connection with the first mechanical assembly 314. The first mechanical assembly includes a connector 336 which is pivotally connected to the pivot pin 334 and a first lever arm 92' which is pivotally connected to the connector 336 and rigidly connected to the input shaft 80'. In this manner, rotation of the input shaft 80' causes a corresponding rotation of the first pivotal member and a corresponding longitudinal movement of the transfer member. The second pivotal member 302 is mounted on a pivot shaft 340 at its pivot end 320. A second elongated slot 342 is disposed longitudinally along the axis of the second pivotal member for receiving the transfer member. A pivot pin 344 is disposed at the free end 322 of the second pivotal member for connection with the second mechanical assembly 324. The second mechanical assembly 324 includes a connector 346 which is pivotally connected with the pivot pin 344 and a second lever arm 94' which is pivotally connected with the connector 346 and rigidly connected with the output shaft 84'. In this manner, longitudinal movement of the transfer member pivots the second pivotal member about pivot 340 and causes a corresponding rotation of the output shaft 84'. The transfer member 304 in the preferred embodiment includes a pair of transfer links one disposed to either side of the first and second pivotal members and first and second transfer member pivot pins 350 and 352. The transfer member pivot pins are connected with appropriate ends of the transfer links and pass through the first and second elongated openings 332 and 342.

The first and second pivotal members, in the preferred embodiment, are of basically identical structure. Accordingly, in FIG. 13, a side view of the first pivotal member 300 is provided and it is to be appreciated that the description applies by analogy to the second pivotal member 302. The ratio changing means includes the pivot shaft 330 which is connected at one end with a drive gear 360 and a pointer 190' to indicate the relative fuel supply rate. The drive gear 360 rotates the pivot shaft 330 and a first miter gear 362. The first miter gear 362 rotates a second miter gear 364 which is connected through a bearing 366 with a screw 368. The screw is threadedly received in the transfer member pivot pin 350. In this manner, rotating the drive gear 360 rotates the screw 368 relative to the transfer member pivot pin 350 moving it longitudinally along the first or second pivotal member. The drive gears of the first and second pivotal members are interconnected by a mechanical interconnecting means 370 such as a belt or gear wheel to undergo simultaneous rotational movement. By suitable placement of the miter gears relative to the mechanical interconnecting means 370, the two interconnected pivotable members 330 can be made to operate so that when pin 350 moves away from pivot shaft 330 in one pivotable member, the opposite motion occurs in the other pivotable member. Consequently, when reversible motor 142' rotates the drive gears, transfer member 304 is shifted longitudinally changing the effective gear ratio of the angular displacement means, hence the air to fuel volume relationship, by a percentage.

Alternately, the transfer motion required of pin 350 can be achieved by means of a cam and return spring arrangement, or by a bellcrank and linkage arrangement instead of the screw arrangement shown in the preferred embodiment. Obviously modifications and alterations will occur to others upon reading and understanding the specification. It is my intention to include all such modifications and alterations insofar as they come within the scope of the appended claims or the equivalents thereof.

Having thus described preferred and alternate embodiments, my invention is now claimed to be:

1. A combustion apparatus comprising:

at least one combustion chamber adapted to oxidize fuel to produce heat and oxidation by-products at least partially in the form of exhaust gases;

a fuel supply for supplying fuel to said combustion chamber, said fuel supply including a fuel regulator for regulating the rate at which fuel is supplied to the combustion chamber;

an air supply for supplying air to said combustion chamber, said air supply including an air regulator for regulating the rate at which air is supplied to the combustion chamber;

a combustion control for controlling the combustion firing rate including controlling the fuel supply rate at which fuel is supplied to the combustion chamber and controlling the air supply rate at which air is supplied to the combustion chamber, said combustion control constraining said fuel supply rate and said air supply rate to a predetermined air-fuel volume relationship, said combustion control including a jackshaft, means for controlling angular displacement of the jackshaft in accordance with a selected combustion chamber load, a mechanical linkage means at least connecting the jackshaft with one of the fuel regulator and the air regulator;

an exhaust gas analyzer for analyzing at least a part of exhaust gases from the combustion chamber;

a comparing means for comparing results of the exhaust gas analysis with a preselected analysis and producing a difference signal indicative of a difference between the exhaust gas analysis and the preselected analysis;

a first rotatable shaft, the mechanical linkage means further connecting the jackshaft with the first shaft such that the first shaft is angularly displaced with angular displacement of the jackshaft to an angular position corresponding to the controlled combustion firing rate;

a second rotatable shaft which is connected by the mechanical linkage means with one of the fuel regulator and the air regulator for controlling the supply rate of said one of the fuel and air supply in accordance with the angular position of the second shaft such that the fuel flow and airflow to the combustion chamber are constrained mechanically to a set air-fuel volume relationship and such that rotating the jackshaft changes the fuel and air supply rates while maintaining for each firing rate the preselected relationship between oxygen supplied for combustion and the supplied combustibles requirement for oxygen in the combustion process;

an angular displacement means connected with the first and second shafts such that angular displacement of the first shaft causes a corresponding angular displacement of the second shaft, the angular displacement means having an effective gear ratio which defines the correspondence between the angular displacement of the first and second shafts;

means for altering said predetermined air-fuel relationship by a selected percentage over all combusion firing rates and fuel supply rates, including a ratio adjusting means for adjusting the gear ratio between the first and second shafts by a percentage to alter said predetermined air-fuel relationship by a percentage, the ratio adjusting means being operatively connected with the angular displacement means and the comparing means for adjusting the gear ratio in response to a difference betwen the exhaust gas analysis and the preselected analysis at preselected firing rates to alter said predetermined air-fuel relationship in response to the comparison of the exhaust gas analysis with the preselected analysis such that the predetermined air-fuel relationship is altered by the same percentage over all combustion firing rates and fuel supply rates; and, means for delivering the difference signal from the comparing means to the ratio adjusting means.

2. The apparatus as set forth in claim 1 wherein the first and second shafts are parallel disposed.

3. The apparatus as set forth in claim 2 wherein the mechanical linkage means connects the jackshaft directly with the fuel regulator and directly with the first shaft and connects the second shaft directly with the air regulator, whereby the combustion control is mechanically connected with the fuel and air supply and the ratio adjusting means adjusts the air supply by the percentage.

4. The apparatus as set forth in claim 1 wherein the angular displacement means includes:

a first pivotal member which is operatively connected with the first shaft to undergo pivotal movement corresponding to angular displacement of the first shaft;

a second pivotal member which is operatively connected with the second shaft to cause angular displacement of the second shaft corresponding to pivotal movement of the second pivotal member; and a transfer means operatively connected with the first and second pivotal members for causing pivotal movement of the first pivotal member to cause a corresponding pivotal movement of the second pivotal member.

5. The apparatus as set forth in claim 4 wherein the first pivotal member has a free end and a pivot end and the second pivotal member has a free end and a pivot end, the first pivotal member free end being disposed generally contiguous to the second pivotal member pivot end and the first pivotal member pivot end being disposed generally contiguous to the second pivotal member free end and wherein the transfer means is a transfer member which is pivotally connected with the first pivotal member between its free and pivot ends and which is pivotally connected with the second pivotal member between its free and pivotal end.

6. The apparatus as set forth in claim 4 wherein the ratio adjusting means includes means for selectively shifting the transfer member pivotal connection with the first pivotal member toward the first pivotal member free end and toward the first pivotal member pivot end.

7. The apparatus as set forth in claim 5 wherein the transfer means includes a first transfer pivot pin slidably disposed in a longitudinally, elongated slot in the first pivotal member, a second transfer pivot pin slidably disposed in a longitudinally elonged slot in the second pivot member, a transfer member connected with the first and second transfer pivot pins and means for selectively positioning the first and second transfer pivot pins along the first and second pivotal member longitudinally elongated slots.

8. The apparatus as set forth in claim 1 wherein said angular displacement means includes a first lever arm operatively connected with the first shaft for angular displacement therewith, a second lever arm operatively connected with the second shaft for angular displacement therewith, and interconnecting means for connecting said first and second lever arms, and wherein said ratio adjustng means includes means for changing the length of at least one of said first and second lever arms.

9. The apparatus as set forth in claim 8 wherein said interconnecting means includes an interconnecting link which is pivotally connected with said first and second lever arms and wherein said ratio adjusting means further includes means for changing the effective length of said interconnecting link.

10. An efficiency improving apparatus for improving the efficiency of a combustion apparatus which combustion apparatus includes:

a combustion chamber, a fuel regulating means for regulating a supply rate of fuel from a fuel supply to the combustion chamber, an air regulating means for regulating a supply rate of air from an air supply to the combustion chamber, a jackshaft, means for controlling angular displacement of the jackshaft in accordance with a selected combustion chamber load, a mechanical linkage means at least connecting the jackshaft with one of the fuel and air regulating means, the efficiency improving apparatus includes:

an exhaust gas analyzing means adapted to analyze at least a part of the exhaust gases from the combustion chamber;

means for comparing the results of the exhaust gas analysis with a preselected analysis at specific firing rates;

a first shaft, the mechanical linkage means further connecting the jackshaft with the first shaft such that the first shaft is angularly displaced with angular displacement of the jackshaft;

a second shaft, the mechanical linkage further connecting the second shaft with the other of the fuel and air regulating means to control the other of the fuel and air regulating means with the angular displacement thereof such that the fuel flow and airflow to the combustion chamber are constrained mechanically to a set air-fuel volume relationship and such that rotating the jackshaft changes the fuel and air supply rates while maintaining for each firing rate the preselected relationship between oxygen supplied for combustion and the supplied combustibles requirement for oxygen in the combustion process;

an angular displacement means interconnecting the first and second shafts such that angular displacement of the first shaft causes a corresponding angular displacement of the second shaft, the angular displacement means providing an effective gear ratio between the first and second shafts, the angular displacement means including a ratio adjusting means for adjusting the effective gear ratio between the first and second shafts by a percentage, the ratio adjusting means being operatively connected with the comparing means for adjusting the effective gear ratio in response to the exhaust gas analysis differing from the preselected analysis, such that the air-fuel relationship is adjusted by the percentage to bring the exhaust gas analysis to the preselected analysis, whereby the air-fuel relationship is adjusted by the same percentage regardless of the angular position of the jackshaft.

11. The apparatus as set forth in claim 10 wherein said efficiency improving apparatus is rotatably disposed in a fixed circular housing such that during installation the first and second shafts are adapted to be suitably aligned with an an mechanical linkage with which the efficiency improving apparatus is to be interconnected.

12. The apparatus as set forth in claim 10 wherein the first and second shafts are parallel disposed.

13. The apparatus as set forth in claim 11 wherein the first shaft is adapted to be connected directly with the jackshaft to be angularly displaced therewith and the second shaft is adapted to be connected directly with the air regulating means such that the adjusting means adjusts the air supply rate by the percentage relative to the fuel supply rate.

14. The apparatus as set forth in claim 11 wherein the first shaft is adapted to be connected directly with the jackshaft to be angularly displaced therewith and the second shaft is adapted to be connected directly with one of the air regulating means and fuel regulating means such that the adjusting means adjusts the relative air and fuel supply rates by the percentage.

15. An efficiency improving apparatus for improving the efficiency of a combustion apparatus, which combustion apparatus includes:

a combustion chamber, a fuel regulating means for regulating a supply rate of fuel from a fuel supply to the combustion chamber, an air regulating means for regulating a supply rate of air from an air supply to the combustion chamber, a jackshaft, means for controlling angular displacement of the jackshaft in accordance with a selected combustion chamber load, a mechanical linkage means connecting the jackshaft with one of the fuel and air regulating means, the efficiency improving apparatus includes:

a first shaft operatively connected with the mechanical linkage means to be angularly displaced with angular displacement of the jackshaft;

a second shaft, the mechanical linkage means connecting the second shaft with the other of the fuel and air regulating means such that the fuel flow and airflow to the combustion chamber are constrained mechanically to a set air-fuel volume relationship and such that rotating the jackshaft changes the fuel and air supply rates while maintaining for each firing rate the preselected relationship between oxygen supplied for combustion and the supplied combustibles requirement for oxygen in the combustion process;

a first pivotal member which is operatively connected with the first shaft to undergo a pivotal movement corresponding to angular displacement of the first shaft;

a second pivotal member which is operatively connected with the second shaft to cause angular displacement of the second shaft corresponding to pivotal movement of the second pivotal member;

a transfer means operatively connected with the first and second pivotal members for causing pivotal movement of the first pivotal member to cause a corresponding pivotal movement of the second pivotal member, whereby angular displacement of the first shaft causes a corresponding angular displacement of the second shaft, the transfer means providing an effective gear ratio between the first and second shafts; and, a ratio adjusting means for adjusting the effective gear ratio between the first and second shafts by a percentage, such that the air-fuel relationship is adjusted by the percentage, the ratio adjusting means being operatively connected with the transfer means and being adapted to be operatively connected with an exhaust gas analyzer for adjusting the effective gear ratio in response to an exhaust gas analysis differing from a preselected analysis to bring the exhaust gas analysis to the preselected analysis.

16. The apparatus as set forth in claim 15 wherein the first pivotal member has a free end and a pivot end and the second pivotal member has a free end and a pivot end, the first and second pivotal members being disposed with the first pivotal member free end disposed generally contiguous to the second pivotal member pivot end at the first pivotal member pivot end disposed generally contiguous to the second pivotal member free end and wherein the transfer means is a transfer member which is pivotally connected with the first pivotal member between its free and pivot ends and which is pivotally connected with the second pivotal member between its free and pivotal end.

17. The apparatus as set forth in claim 16 wherein the ratio adjusting means include means for selectively shifting the transfer member pivotal connection with the first pivotal member toward the first pivotal member free end and toward the first pivotal member pivot end.

18. The apparatus as set forth in claim 16 wherein the transfer means includes a first transfer pivot pin slidably disposed on the first pivotal member, a second transfer pivot pin slidably disposed on the second pivot member, a transfer member connected with the first and second transfer pivot pins and means for selectively positioning the first and second transfer pivot pins along the first and second pivotal members.

19. The apparatus as set forth in claim 10 wherein said angular displacement means includes a first lever arm operatively connected with the first shaft for angular displacement therewith, a second lever arm operatively connected with the second shaft for angular displacement therewith, and interconnecting means for connecting said first and second lever arms, and wherein said ratio adjusting means includes means for changing the length of at least one of said first and second lever arms.

20. The apparatus as set forth in claim 19 wherein said interconnecting means includes an interconnecting link which is pivotally connected with said first and second lever arms and wherein said ratio adjusting means further includes means for changing the effective length of said interconnecting link.

* * * * *